US007890044B2

(12) United States Patent
Shimizu et al.

(10) Patent No.: US 7,890,044 B2
(45) Date of Patent: Feb. 15, 2011

(54) POWDER CONVEYANCE DEVICE, TONER CONVEYANCE DEVICE, PROCESS CARTRIDGE AND IMAGE FORMING APPARATUS

(75) Inventors: Yoshiyuki Shimizu, Osaka (JP); Kenzo Tatsumi, Osaka (JP); Yoshihiro Kawakami, Hyogo (JP); Tomohiro Kubota, Osaka (JP); Koji Kato, Tokyo (JP); Hirobumi Ooyoshi, Tokyo (JP); Tomofumi Yoshida, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 563 days.

(21) Appl. No.: 11/967,635

(22) Filed: Dec. 31, 2007

(65) Prior Publication Data

US 2008/0170898 A1 Jul. 17, 2008

(30) Foreign Application Priority Data

Jan. 17, 2007 (JP) ..... 2007-007955

(51) Int. Cl.
*G03G 21/00* (2006.01)

(52) U.S. Cl. ..... 399/359; 399/120; 399/350

(58) Field of Classification Search ..... 399/119, 399/120, 262, 343, 350, 358, 359, 360
See application file for complete search history.

(56) References Cited

U.S. PATENT DOCUMENTS 5,532,795 A 7/1996 Tatsumi et al.
5,557,382 A 9/1996 Tatsumi et al.
5,678,125 A * 10/1997 Kutsuwada et al. ..... 399/26
5,734,953 A 3/1998 Tatsumi
5,765,079 A 6/1998 Yoshiki et al.
5,815,767 A 9/1998 Kutsuwada et al.
5,828,935 A 10/1998 Tatsumi et al.
5,887,224 A 3/1999 Mizuishi et al.
5,915,143 A 6/1999 Watanabe et al.
5,956,556 A * 9/1999 Nakajima et al. ..... 399/359
6,006,050 A 12/1999 Watanabe et al.
6,055,388 A 4/2000 Watanabe et al.
6,085,062 A 7/2000 Mizuishi et al.
6,128,449 A 10/2000 Zenba et al.
6,144,811 A 11/2000 Ohori et al.
6,144,822 A 11/2000 Yamaguchi et al.

(Continued)

FOREIGN PATENT DOCUMENTS

JP 11-73078 3/1999

OTHER PUBLICATIONS

U.S. Appl. No. 12/170,842, filed Jul. 10, 2008, Kubota, et al.

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

A powder conveyance device capable of removing toner (powder) stuck to a conveyor belt easily and reliably comprises a powder conveyor belt having a plurality of concavo-convex portions formed continuously on a conveyance surface thereof, driving means for driving the conveyor belt, and a scraping member that contacts the conveyor belt. At least one of the scraping member and a convex portion of the conveyor belt deforms elastically such that a tip end of the scraping member enters a concave portion and scrapes away the powder stuck to the conveyor belt.

13 Claims, 11 Drawing Sheets

U.S. PATENT DOCUMENTS

| | | | |
|---|---|---|---|
| 6,148,161 | A | 11/2000 | Usui et al. |
| 6,160,969 | A | 12/2000 | Ishigaki et al. |
| 6,266,501 | B1 | 7/2001 | Mizuishi et al. |
| 6,628,903 | B1 | 9/2003 | Ohori et al. |
| 6,665,511 | B2 | 12/2003 | Takeuchi et al. |
| 6,771,918 | B2 | 8/2004 | Tatsumi |
| 6,898,383 | B2 | 5/2005 | Ohori et al. |
| 7,027,761 | B2 | 4/2006 | Koetsuka et al. |
| 7,110,710 | B2 | 9/2006 | Yamashita et al. |
| 7,184,691 | B2 | 2/2007 | Kita et al. |
| 7,214,461 | B2 | 5/2007 | Yamashita et al. |
| 2002/0076237 | A1* | 6/2002 | Ziegelmuller et al. ..... 399/123 |
| 2003/0219669 | A1 | 11/2003 | Yamashita et al. |
| 2006/0268373 | A1 | 11/2006 | Tatsumi et al. |
| 2007/0104523 | A1 | 5/2007 | Yoshida et al. |
| 2007/0140747 | A1 | 6/2007 | Kita et al. |
| 2007/0140763 | A1 | 6/2007 | Shimizu et al. |
| 2007/0212119 | A1 | 9/2007 | Kurenuma et al. |
| 2007/0248390 | A1 | 10/2007 | Kubota et al. |

* cited by examiner

POWDER CONVEYANCE DEVICE, TONER CONVEYANCE DEVICE, PROCESS CARTRIDGE AND IMAGE FORMING APPARATUS

BACKGROUND OF THE INVENTION

1. Field of the Invention

The present invention relates to a powder conveyance device, and more particularly to a toner conveyance device that conveys waste toner discharged from an image creating mechanism of an image forming apparatus to a collection unit. The present invention also relates to a process cartridge and the image forming apparatus that comprise the toner conveyance device.

2. Description of the Related Art

In a known image forming apparatus such as a copier, a printer, a facsimile device or a compound device thereof, waste toner removed from the surface of an image carrier is conveyed to a collection unit by conveying means. The conveying means may be formed by having a conveyor belt provided with a plurality of concavo-convex portions on the conveyance surface thereof travel around a loop-shaped groove, for example (see Japanese Unexamined Patent Application Publication H11-73078). The toner is accommodated in the concave portions of the conveyor belt, conveyed to the collection unit, dropped into the collection unit, and thereby collected.

However, with conveying means employing a conveyor belt such as that disclosed in this publication, it is impossible to drop all of the conveyed toner into the collection unit, and a small amount of toner remains on the concavo-convex portions of the conveyor belt. As the residual toner deteriorates, it sticks to the conveyor belt, leading to a reduction in the volume of the recess portions and a corresponding reduction in conveyance ability.

SUMMARY OF THE INVENTION

The present invention has been designed in consideration of these circumstances, and it is an object thereof to provide a powder conveyance device and a toner conveyance device that can remove toner (powder) stuck to a conveyor belt easily and reliably, as well as a process cartridge and an image forming apparatus employing the toner conveyance device.

In an aspect of the present invention, a powder conveyance device comprises a powder conveyor belt having a plurality of concavo-convex portions formed continuously on a conveyance surface thereof; a driving device for driving said conveyor belt; and a scraping member that contacts the conveyor belt. At least one of the scraping member and a convex portion of the conveyor belt deforms elastically such that a tip end of the scraping member enters a concave portion and scrapes away a powder stuck to the conveyor belt.

In another aspect of the present invention, a toner conveyance device for conveying toner using a powder conveyance device comprises a powder conveyor belt having a plurality of concavo-convex portions formed continuously on a conveyance surface thereof; a driving device for driving the conveyor belt; and a scraping member that contacts the conveyor belt. At least one of the scraping member and a convex portion of the conveyor belt deforms elastically such that a tip end of the scraping member enters a concave portion and scrapes away a powder stuck to the conveyor belt.

In another aspect of the present invention, a process cartridge can be attached to and detached from an image forming apparatus main body and has a cleaning device for removing residual toner from an image carrier and a toner conveyance device for conveying the residual toner removed by the cleaning device. The toner conveyance device conveys the toner using a powder conveyance device. The powder conveyance device comprises a powder conveyor belt having a plurality of concavo-convex portions formed continuously on a conveyance surface thereof; a driving device for driving the conveyor belt; and a scraping member that contacts the conveyor belt. At least one of the scraping member and a convex portion of the conveyor belt deforms elastically such that a tip end of the scraping member enters a concave portion and scrapes away a powder stuck to the conveyor belt.

In another aspect of the present invention, an image forming apparatus has a cleaning device for removing residual toner from an image carrier and a toner conveyance device for conveying said residual toner removed by said cleaning device. The toner conveyance device conveys the toner using a powder conveyance device. The powder conveyance device comprises a powder conveyor belt having a plurality of concavo-convex portions formed continuously on a conveyance surface thereof; a driving device for driving the conveyor belt; and a scraping member that contacts said conveyor belt. At least one of the scraping member and a convex portion of the conveyor belt deforms elastically such that a tip end of the scraping member enters a concave portion and scrapes away a powder stuck to the conveyor belt.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENTS

An embodiment of the present invention will be described below with reference to the attached drawings.

Figure 1:
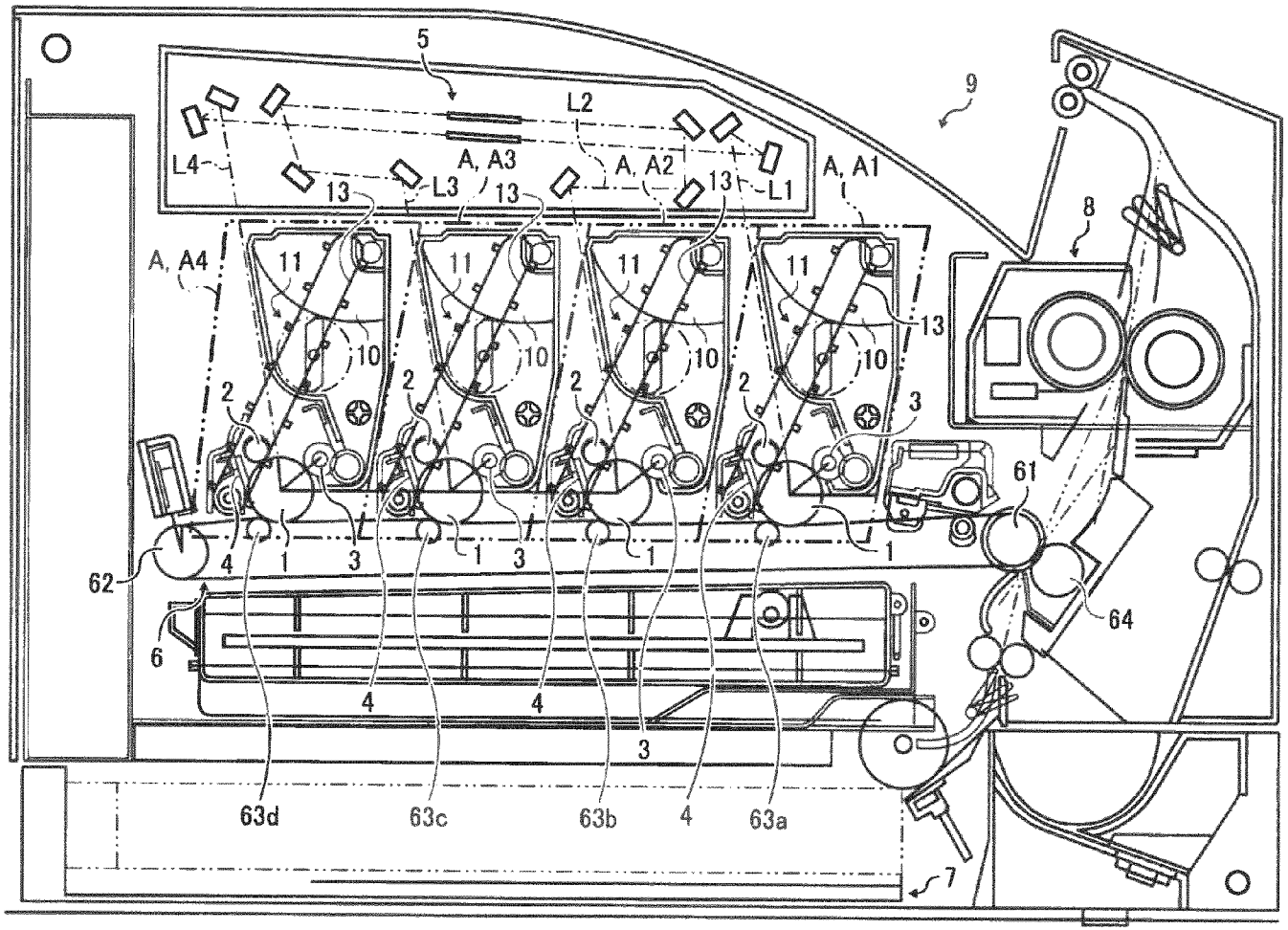
FIG. 1 is a sectional view showing the schematic constitution of an image forming apparatus having a powder conveyance device according to an embodiment of the present invention as a toner conveyance device.

FIG. 1 shows an outline of a color image forming apparatus according to this embodiment. The image forming apparatus includes an image creating unit for forming an image using developer in each of yellow, magenta, cyan and black, corresponding to the color separation components of a color image.

Figure 2:
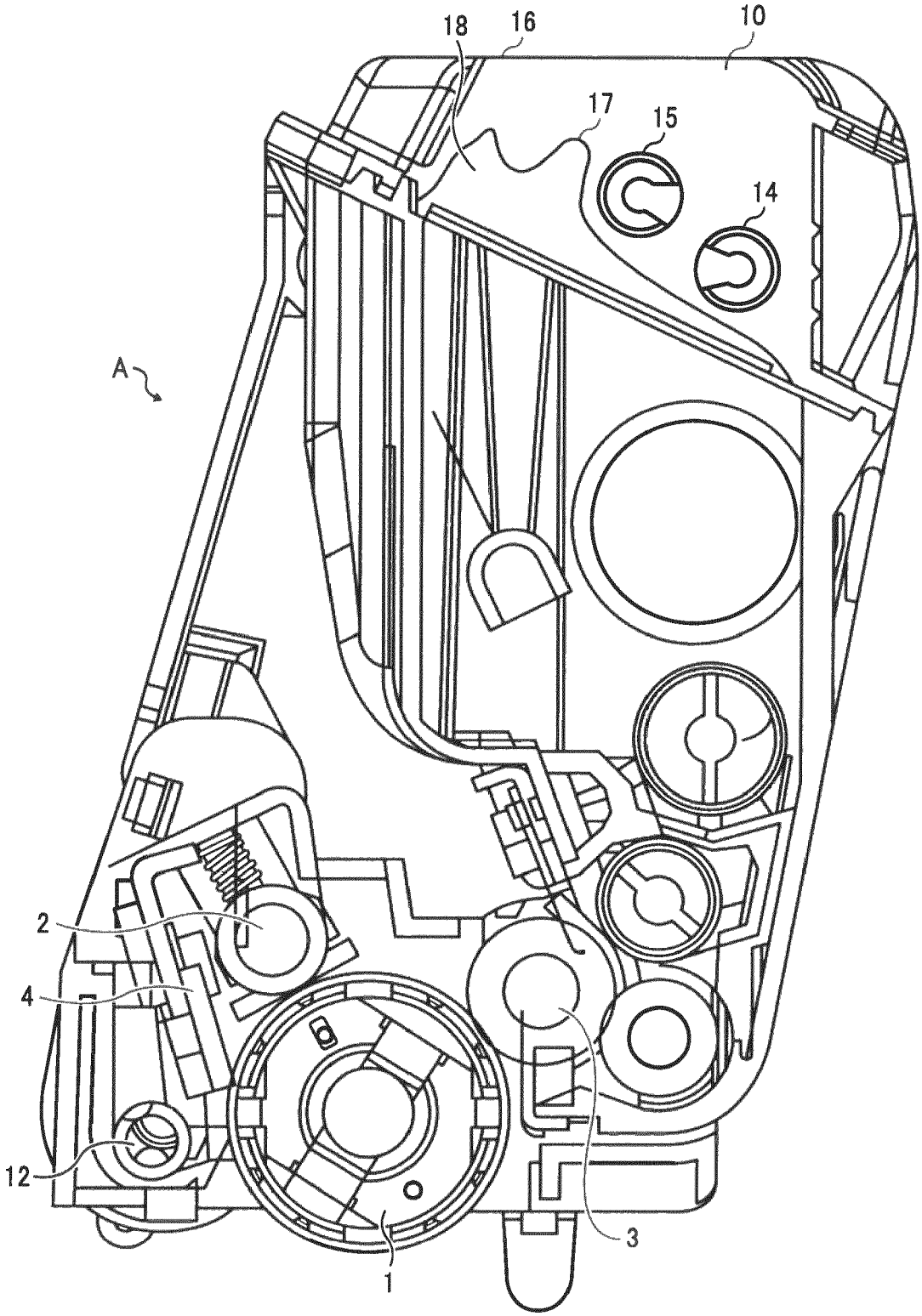
FIG. 2 is a side view showing the schematic constitution of a process cartridge comprising the powder conveyance device as a toner conveyance device.

The main parts of the image forming apparatus will now be described on the basis of FIG. 1. Four process cartridges A (first process cartridge A1 to fourth process cartridge A4), each having an image carrier 1 (photosensitive drum), a charger 2, a development device 3, a cleaning blade 4 (cleaning device) and soon formed integrally as an image forming unit, are mounted detachably in the interior of the image forming apparatus. FIG. 2 shows an outline of the structure of the process cartridge A. Each development device 3 houses toner of a different color serving as a developer.

In FIG. 1, an exposure device 5 for exposing the respective image carriers 1 is disposed above the process cartridges A, and an intermediate transfer belt 6 is disposed below the process cartridges A. The intermediate transfer belt 6 is wrapped around a drive roller 61, a driven roller 62, and four primary transfer rollers 63*a*, 63*b*, 63*c*, 63*d* opposing the respective image carriers 1, and performs a circulatory motion around these rollers.

A basic image creation operation performed by the image forming apparatus will now be described.

First, the surface of the image carrier 1 is charged to a uniform high potential by the charger 2. Next, the surface of the image carrier 1 is irradiated with a laser beam (L1 to L4) from the exposure device 5 on the basis of image data, causing the potential of the irradiated parts to decrease such that an electrostatic latent image is formed. Toner is transferred from the development device 3 to the surface part of the image carrier 1 formed with the electrostatic latent image, and as a result, toner images of each color are formed (developed). The toner images of each color formed on the respective image carriers 1 are transferred onto the intermediate transfer belt 6 so as to be superposed thereon, and the resulting superposed transferred toner image is transferred onto a sheet of paper (not shown) conveyed from a sheet feeding cassette 7 by a secondary transfer roller 64. Following transfer of the toner image, the sheet is conveyed to a fixing device 8, where the toner image is fixed on the sheet, and finally the sheet is discharged to a sheet discharge unit 9 provided in an upper portion of the image forming apparatus main body.

Meanwhile, toner remaining on the surface of the respective image carriers 1 following transfer is scraped away by the cleaning blade 4. Each process cartridge A comprises a collection unit 10 for collecting scraped waste toner, and toner conveying means 11 for conveying the waste toner to the collection unit 10.

Figure 3:
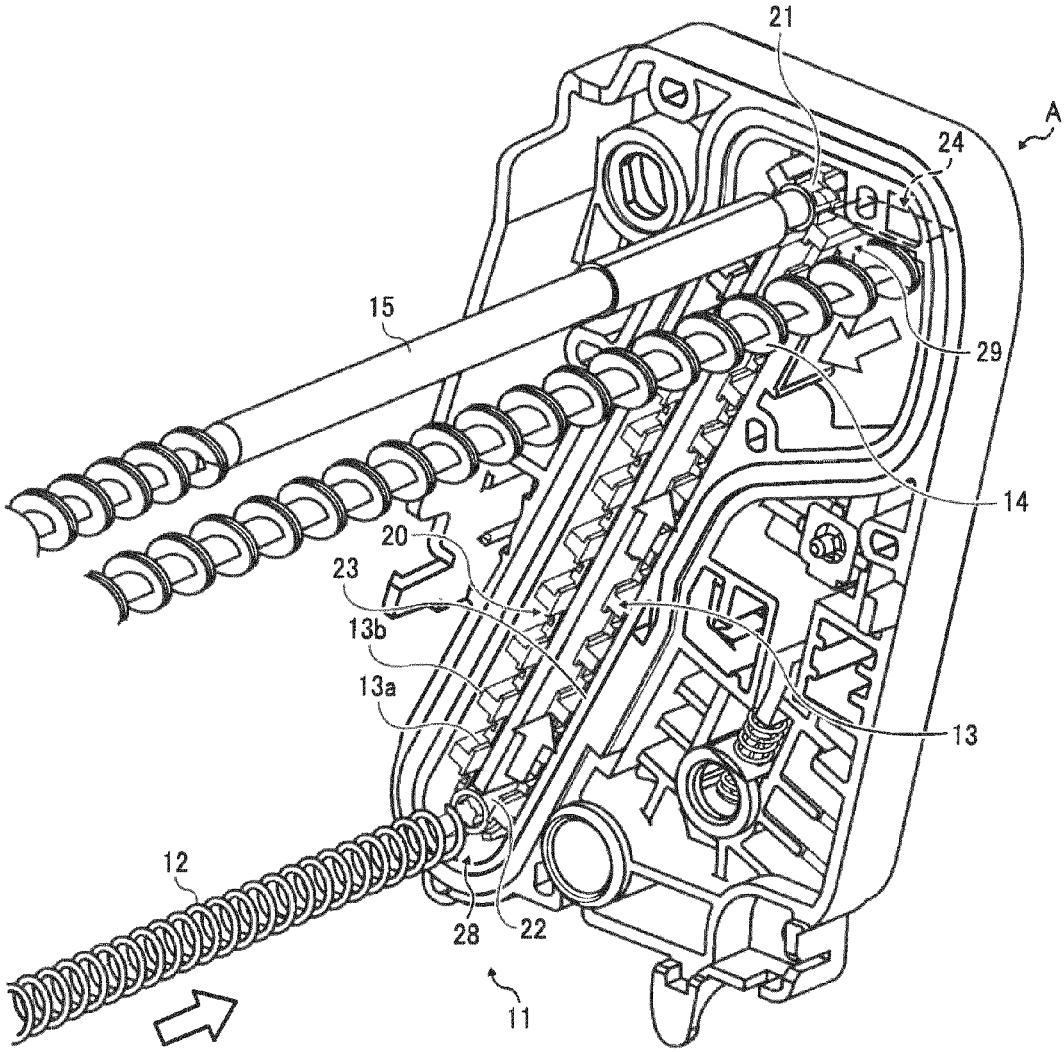
FIG. 3 is a perspective view showing in detail a cross-section of the process cartridge.

FIG. 3 shows a cross-section of the process cartridge. As shown in the drawing, the toner conveying means 11 comprise a lower conveyance screw 12 (spiral coil) for conveying waste toner scraped away by the cleaning blade 4 (see FIG. 2) horizontally, a conveyor belt 13 for conveying the waste toner conveyed from the lower conveyance screw 12 upward, and two upper conveyance screws 14, 15 (screw shafts) that introduce the waste toner carried on the conveyor belt 13 into the collection unit 10 and agitate the toner internally.

In FIG. 2, a toner storage unit 16 is provided in the upper portion of the process cartridge A, and a deformable partitioning member 17 is provided in the toner storage unit 16. The partitioning member 17 is constituted by a film-form member, and the toner storage unit 16 is partitioned into a lower unused toner storage unit 18 and the upper waste toner collection unit 10 by the partitioning member 17. When the amount of unused toner in the storage unit 18 decreases through use and the amount of waste toner collected in the collection unit 10 increases, the partitioning member 17 is gradually pushed downward by the weight of the accumulated waste toner.

Figure 4:
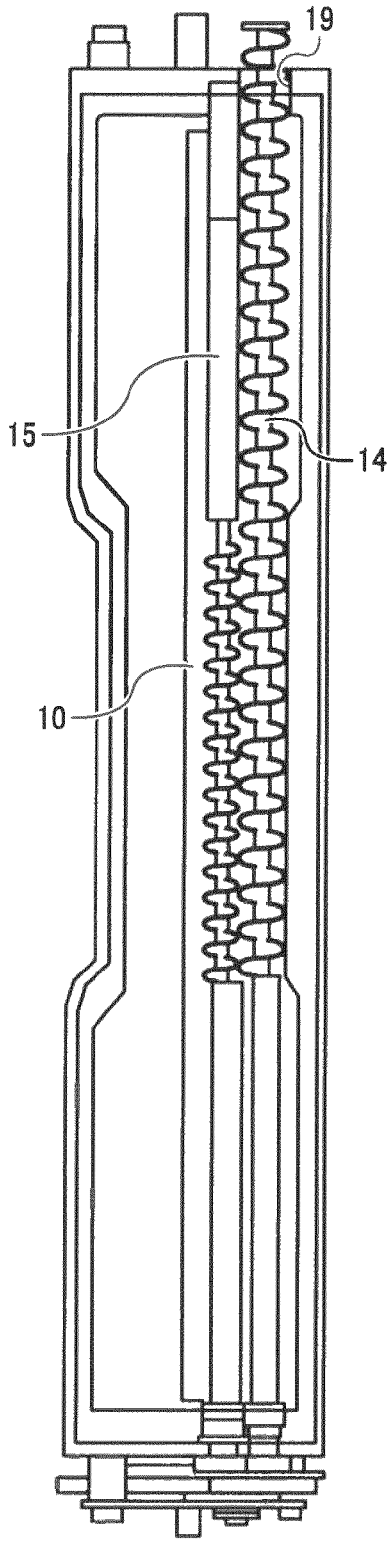
FIG. 4 is a plan view showing in detail a cross-section of the process cartridge.

FIG. 4 shows the waste toner collection unit 10 from above. Of the two conveyance screws 14, 15, one end of the longer conveyance screw 14 projects from a case forming the collection unit 10, and a hole portion of the case, which is penetrated by the end of the conveyance screw 14, serves as a feeding port 19 for leading the waste toner into the interior. The spiral ribs of the two conveyance screws 14, 15 are formed with an identical orientation, but are rotated in opposite directions. More specifically, the longer conveyance screw 14 carries toner to the back side (the lower side in FIG. 4) of the collection unit 10 whereas the shorter conveyance screw 15 conveys toner to the front side (the upper side in FIG. 4) of the collection unit 10. Thus, the deformable partitioning member 17 can expand downward so as to accommodate the waste toner with a high degree of efficiency.

The conveyor belt 13, shown in FIG. 3, is an endless belt that moves in a circulatory fashion around a loop-shaped toner conveyance path 20, and is stretched tightly around a drive shaft 21 (driving means), which is provided on the toner conveyance path 20 so as to be free to rotate, and a roller 22. Hence, the conveyor belt 13 is stretched around two shafts, but may be stretched around three or more shafts. Note that the shorter conveyance screw 15 is connected to the drive shaft 21, and the drive shaft 21 drives both the conveyor belt 13 and the conveyance screw 15. A plurality of concavo-convex portions 13*a*, 13*b* are formed on the outer peripheral-side conveyance surface of the conveyor belt 13, and the waste toner is held and conveyed between the convex portions 13*b* and a peripheral wall 23 of the toner conveyance path 20. Note that a slight gap is provided between the convex portion 13*b* of the conveyor belt 13 and the peripheral wall 23.

Figure 5:
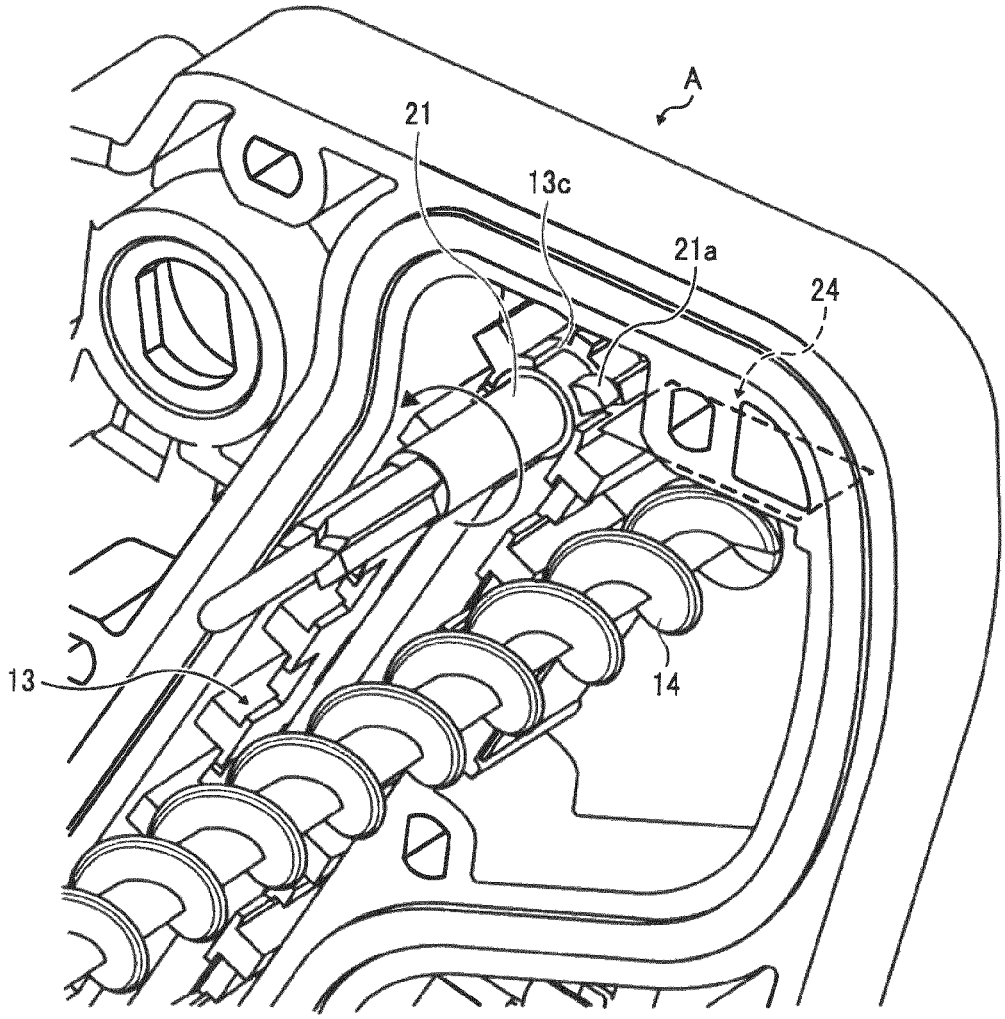
FIG. 5 is a perspective view showing an enlarged cross-section of the main parts of the process cartridge.

Further, as shown in FIG. 5, which is an enlargement of the main parts of FIG. 3, a projecting portion 21*a* is provided on the outer periphery of the drive shaft 21, and the projecting portion 21*a* engages with a notch portion 13*c* formed in the conveyor belt 13 so as to apply a driving force thereto.

Figure 6:
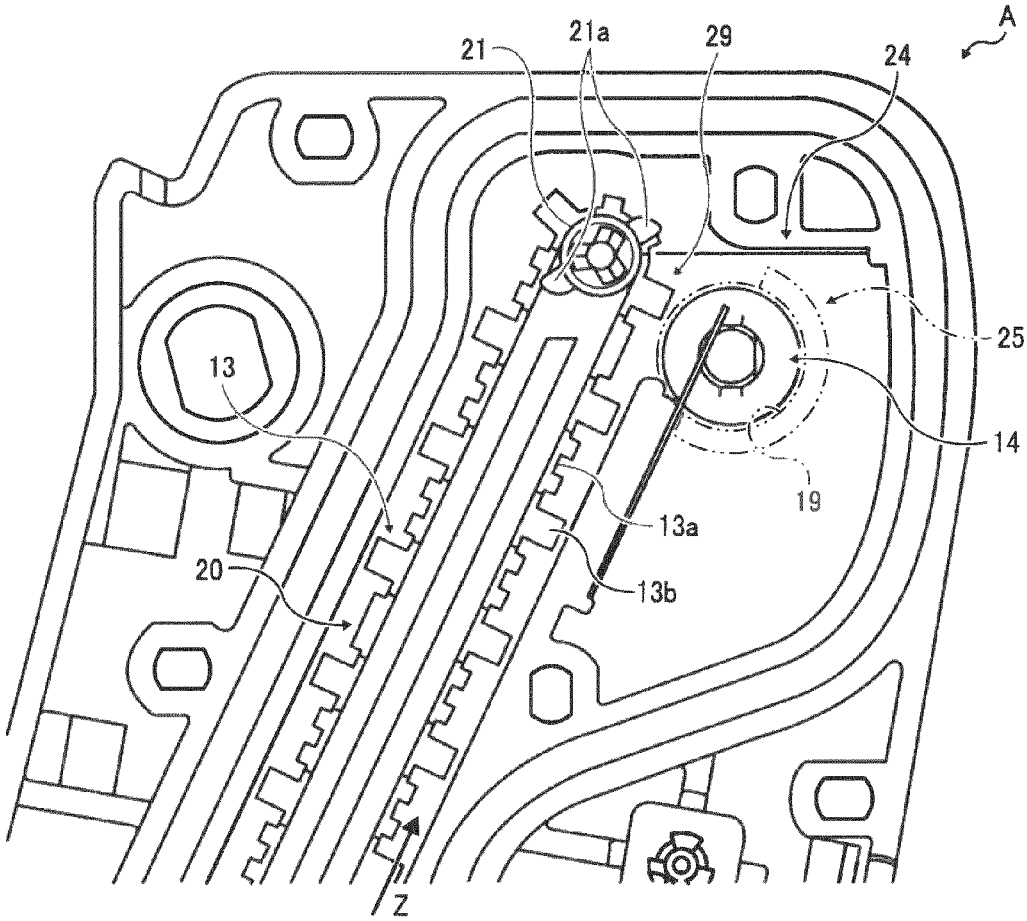
FIG. 6 is a side view showing an enlarged cross-section of the main parts of the process cartridge.

As shown in FIGS. 3, 5 and 6, a scraping member 24 for scraping away waste toner stuck to the conveyor belt is provided near an upper end of the conveyor belt 13 and in contact with the conveyor belt 13. The scraping member 24 is an elastic body constituted by a thin member made of polyethylene terephthalate (PET), and deforms elastically upon contact with the convex portion 13*b* of the moving conveyor belt 13.

The modulus of elasticity of the scraping member 24 is preferably set at a lower limit of 1 GPa and an upper limit of 10 GPa. By setting the modulus of elasticity of the scraping member 24 in this way, the scraping member 24 can deform elastically to an extent that allows smooth movement of the conveyor belt 13 upon contact with the convex portion and exhibit a sufficient restoring force following elastic deformation to scrape away the toner stuck to the conveyor belt 13 (the concave portion 13*a* in particular). Further, it is sufficient for at least one of the scraping member 24 and the convex portion 13*b* of the conveyor belt 13 to be capable of elastic deformation, but in order to convey the toner with stability, the convex portion 13*b* is preferably formed from a non-elastic body.

The conveyor belt 13 is disposed at an incline to the horizontal plane, and as shown by an arrow Z in FIG. 6, the waste toner is held on a conveyance surface side facing the lower side of the conveyor belt 13 and carried upward. The scraping member 24 is disposed so as to contact this conveyance surface side facing the lower side of the upwardly moving conveyor belt 13. By disposing the scraping member 24 in this position, a receiving member 25 for receiving the toner that is scraped away by the scraping member 24 and the conveyance screw 14 can be disposed easily below the tip end of the scraping member 24. Furthermore, since the convex portion 13*b* of the conveyor belt 13 contacts the scraping member 24 from below, the toner can be scraped away by the lower surface side of the scraping member 24. Further, the tip end of the scraping member 24 swings downward following scraping as a result of elastic restoration, and thus the waste toner scraped away by the lower surface side can be scraped downward (to an inlet of the receiving member 25 and the conveyance screw 14 side) quickly. Hence, the receiving member 25 and conveyance screw 14 can receive the toner scraped away by the tip end of the scraping member 24 efficiently. Further, the feeding port 19 opening into the collection unit 10 is disposed below the scraping member 24 so that the waste toner can be conveyed smoothly through the feeding port 19 into the collection unit 10. Note that the feeding port 19 may be provided at the same height as the scraping member 24.

Further, an upper surface of the scraping member 24 on the opposite side to the lower surface that contacts the convex portion 13*b* is annexed to a casing of the process cartridge A. By forming the contact surface and the annexed surface of the scraping member 24 on opposite sides, the scraping member 24 is unlikely to come unstuck upon contact with the convex portion 13*b*, and hence an increase in the life of the scraping member 24 can be achieved.

Figure 7:
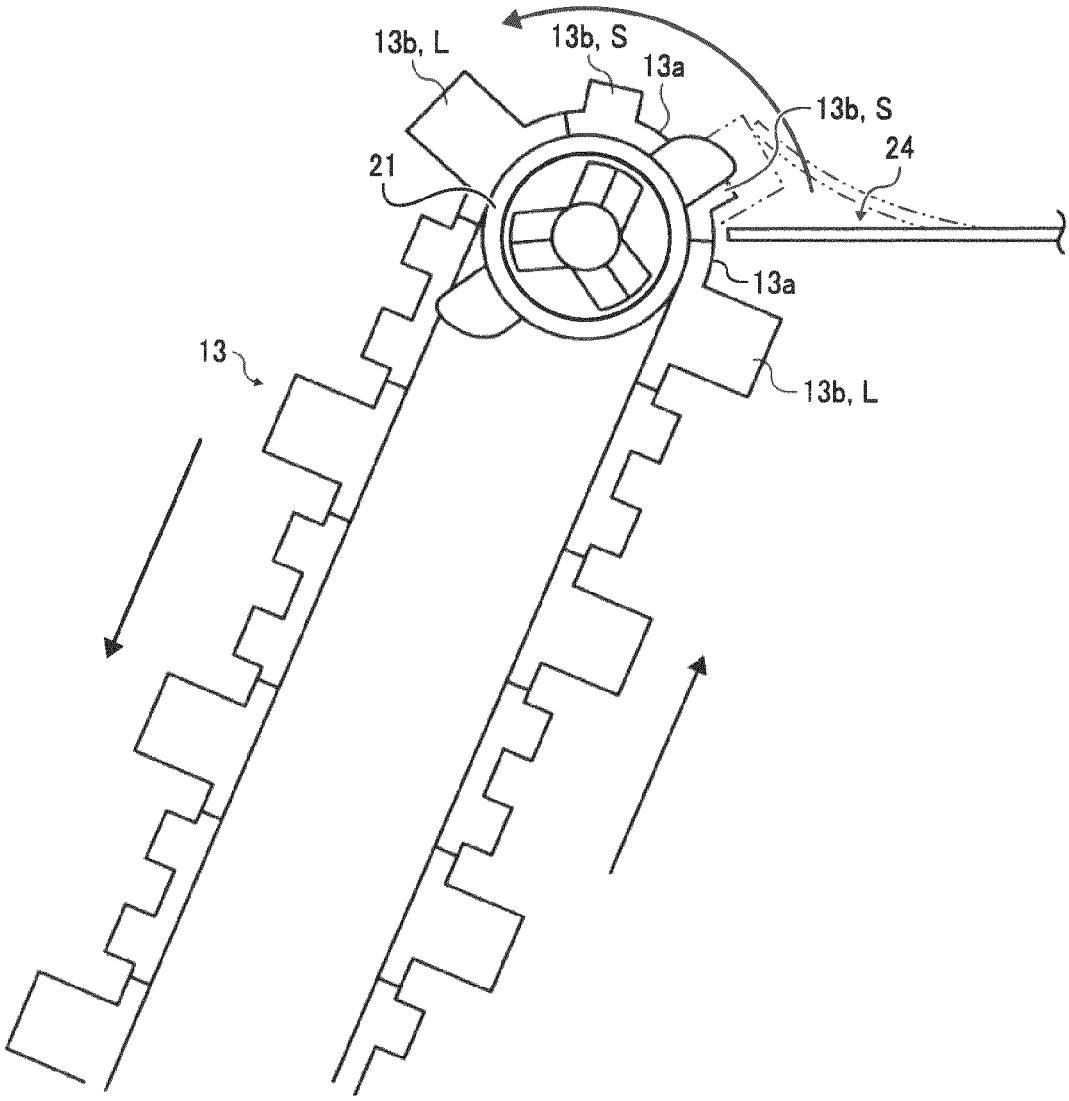
FIG. 7 is a side view showing the constitution of the main parts of a conveyor belt and a scraping member of the process cartridge.

The scraping member 24 is disposed to contact the conveyor belt 13 at a turning portion formed at the point where the conveyor belt 13 turns. More specifically, as shown in FIG. 7, adjacent convex portions 13*b* of the conveyor belt 13 bend at the turning portion, thereby separating from each other such that the concave portion 13*a* widens. As a result of this bending deformation and the consequent enlargement of the concave portion 13*a* space, the toner in the concave portion 13*a* is loosened and the tip end of the scraping member 24 enters the concave portion 13*a* more easily, and therefore the toner stuck to the conveyor belt 13 can be scraped away efficiently.

Further, by disposing the scraping member 24 so that it contacts the upper end of the conveyor belt 13 or the vicinity thereof, the conveyance screw 14 and the feeding port 19 that opens into the collection unit 10 can be disposed in the upper portion of the process cartridge A. Hence, the deformable partitioning member 17 shown in FIG. 2, which separates the unused toner storage unit 18 from the waste toner collection unit 10, can be disposed as far toward the upper side as possible, and a large storage capacity can be secured in the unused toner storage unit 18. Furthermore, by employing the deformable partitioning member 17 in this embodiment of the present invention, the toner storage unit 16 of the process cartridge A can be made compact while ensuring that the unused toner storage unit 18 has a sufficient storage capacity.

FIG. 7 shows two types of convex portion 13*b*, namely a large convex portion 13*b* (L) and a small convex portion 13*b* (S). In this case, the scraping member 24 contacts both the large convex portion 13*b* (L) and the small convex portion 13*b* (S), but a case in which the scraping member 24 contacts only the large convex portion 13*b* (L) is also possible. Further, to increase the capacity for scraping away toner stuck to the conveyor belt 13, the scraping member 24 may be caused to contact the bottom surface of the concave portion 13*a*. However, in order to suppress torque loss generated in the drive shaft 21 of the conveyor belt 13 upon contact with the scraping member 24, the scraping member 24 preferably does not contact the bottom surface of the concave portion 13*a*.

The toner conveying means provided in the image forming apparatus operate in the following manner. In FIG. 2, toner remaining on the surface of each image carrier 1 following transfer is scraped away by the cleaning blade 4. The scraped waste toner is conveyed in a horizontal direction by the lower rotating conveyance screw 12 and carried to a lower portion inlet 28 (see FIG. 3) to the toner conveyance path 20. The conveyor belt 13 circulating around the toner conveyance path 20 accommodates the waste toner in the concave portions 13*a* and conveys the waste toner upward from a lower end position thereof. The waste toner in the concave portions 13*a* falls under its own weight to the conveyance screw 14 side at an upper portion outlet 29 (see FIG. 3) of the toner conveyance path 20, whereupon the waste toner is conveyed to and stored in the collection unit 10 by the conveyance screw 14.

Following transfer to the conveyance screw 14 side, some waste toner remains stuck to the concave and convex portions 13*a*, 13*b* (particularly the concave portions 13*a*) of the conveyor belt 13, and this waste toner is scraped away by the scraping member 24. More specifically, as shown in FIG. 7, the convex portion 13*b* of the upwardly moving conveyor belt 13 contacts the tip end lower surface of the scraping member 24. As the convex portion 13*b* moves upward, the tip end of the scraping member 24 is pushed up by the convex portion 13*b* so as to deform elastically, as shown by the dot-dot-dash line. Once the convex portion 13*b* has progressed to a certain position, the tip end of the scraping member 24 is dislodged from the convex portion 13*b* such that the tip end thereof swings downward by means of elastic restoration. At this time, the tip end of the scraping member 24 enters the space between convex portions 13*b*, and thus the scraping member 24 is able to scrape away the waste toner stuck to the concave and convex portions 13*a*, 13*b* or break down lumps of toner and allow the toner to fall downward. The falling waste toner is received by the receiving member 25 and carried into the collection unit 10 by the conveyance screw 14 (see FIGS. 4 and 6).

Figure 8:
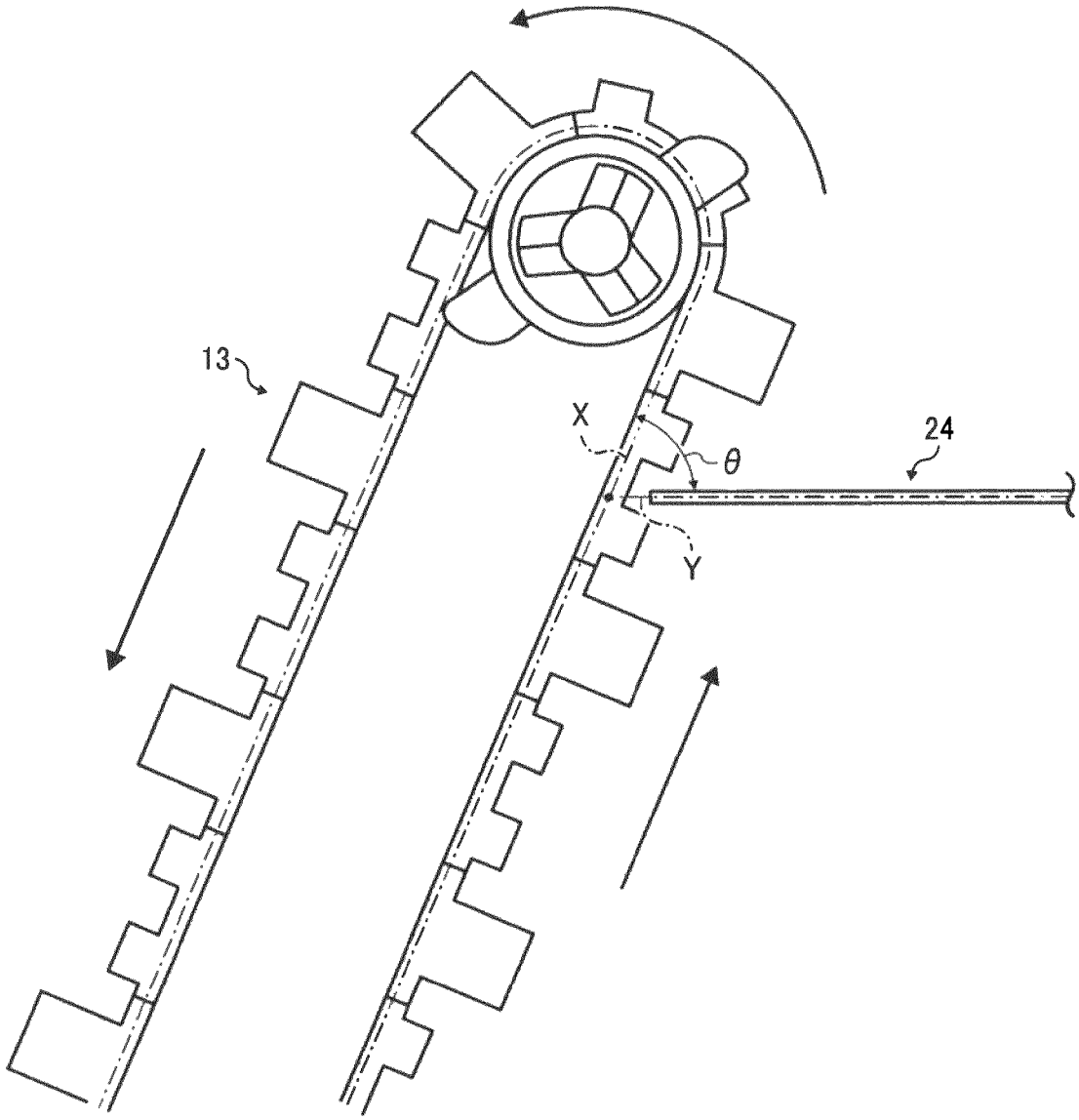
FIG. 8 is a side view showing the constitution of the main parts of a conveyor belt and a scraping member according to another embodiment of the present invention.

FIG. 8 shows the constitution of a conveyor belt and a scraping member according to another embodiment of the present invention. In this case, the disposal position of the scraping member 24 is set to be slightly lower than the position shown in FIG. 7. Similarly to the embodiment described above, the conveyor belt 13 is disposed at an incline to the horizontal plane, and the scraping member 24 is disposed so as to contact a conveyance surface side facing the lower side of the upwardly moving conveyor belt 13. In this embodiment, a belt advancement direction-side angle θ formed by a movement path reference line X of the conveyor belt 13 and an extension line Y of the scraping member 24 in contact therewith is set at an acute angle.

Actions and effects obtained by setting the angle θ in this manner will be described below with reference to FIGS. 9A, 9B, 10A and 10B.

Figure 9A:
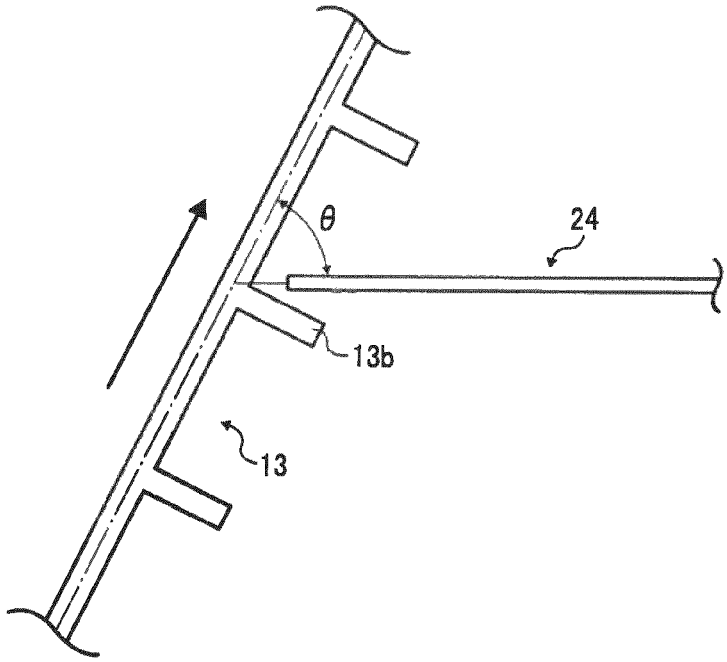
FIG. 9A is a view illustrating an action of the scraping member before contacting a convex portion of the conveyor belt.
Figure 9B:
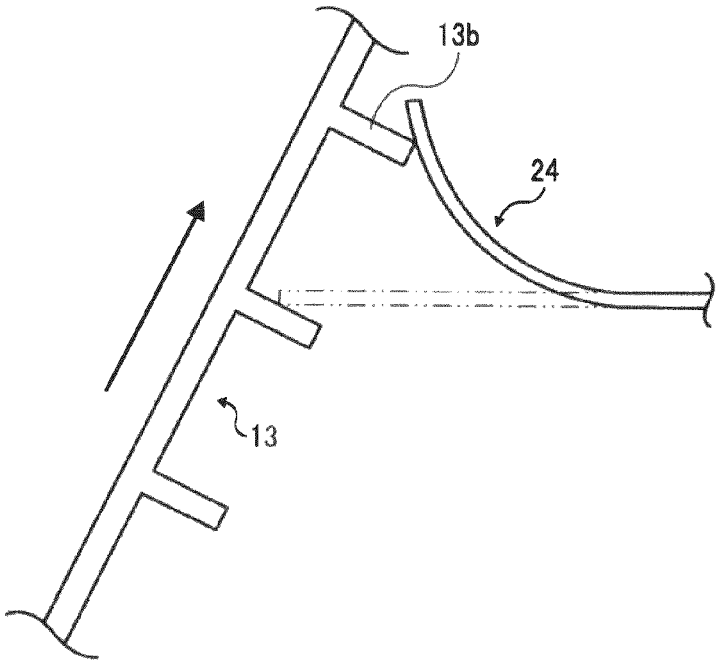
FIG. 9B is a view showing a state of contact between the scraping member and the convex portion of the conveyor belt.
Figure 10A:
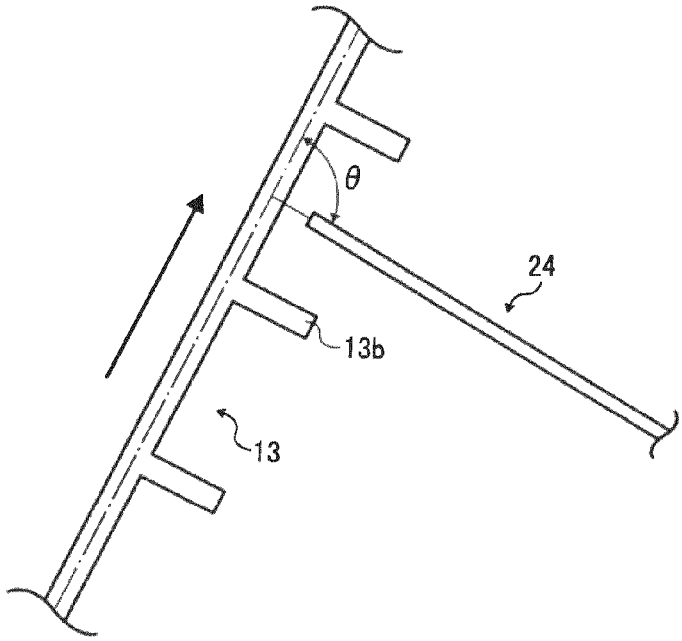
FIG. 10A is a view illustrating an action of the scraping member before contacting a convex portion of the conveyor belt in a comparative example.
Figure 10B:
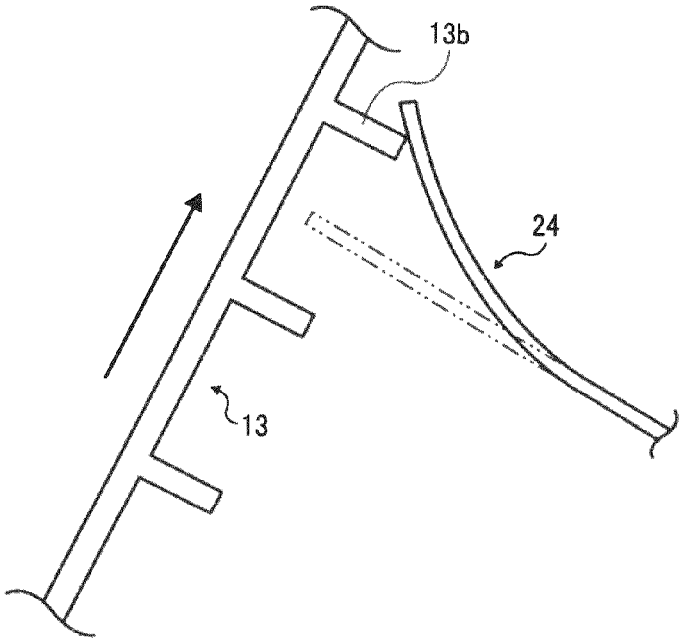
FIG. 10B is a view showing a state of contact between the scraping member and the convex portion of the conveyor belt.

FIGS. 9A and 9B show a case in which the angle θ is set at an acute angle, while FIGS. 10A and 10B show a case in which the angle θ is set at an obtuse angle. In the case shown in FIGS. 9A and 9B, where the angle θ is an acute angle, the scraping member 24 is capable of large elastic deformation from the state shown in FIG. 9A, in which contact between the convex portion 13*b* and the scraping member 24 is not yet established, to the state shown in FIG. 9B, in which the convex portion 13*b* has come into contact with the scraping member 24 and advanced slightly forward. However, in the case shown in FIGS. 10A and 10B, where the angle θ is an obtuse angle, the extent of the elastic deformation of the scraping member 24 is small from the state shown in FIG. 10A, in which contact between the convex portion 13*b* and the scraping member 24 is not yet established, to the state shown in FIG. 10B, in which the convex portion 13*b* has come into contact with the scraping member 24 and advanced slightly forward. Therefore, although toner stuck to the conveyor belt 13 can be scraped away when the angle θ is an obtuse angle, the angle θ is preferably set at an acute angle, as shown in FIGS. 9A and 9B, in order to break down and scrape away toner lumps stuck to the conveyor belt 13 efficiently using the large elastic restoring force of the scraping member 24.

Figure 11A:
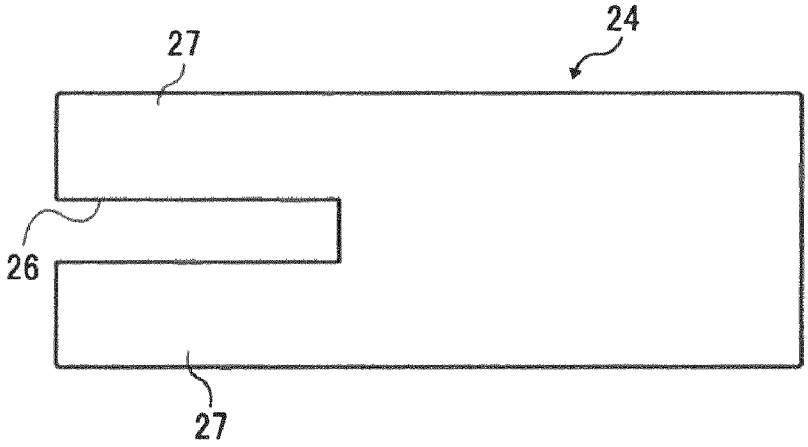
FIG. 11A is a plan view showing a scraping member according to another example of the present invention.
Figure 11B:
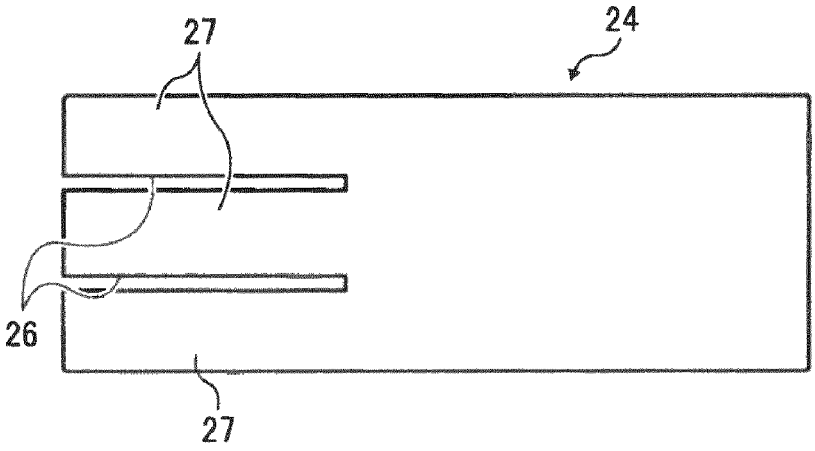
FIG. 11B is a plan view showing a scraping member according to a further example.

FIGS. 11A and 11B show two further examples of the scraping member. As shown in FIGS. 11A and 11B, one or two slits 26 are formed in the tip end of the scraping member 24 to form independent, elastically deformable contact pieces 27. Three or more of the contact pieces 27 may be formed. Thus, the tip end of the scraping member 24 can contact the conveyor belt 13 in a plurality of width direction locations. Therefore, even in cases where toner is stuck to the surface of the conveyor belt 13 unevenly, the conveyance surface of the conveyor belt 13 has a complicated shape, and so on, the respective contact pieces 27 can deform elastically in accordance with the manner in which the toner is stuck or the shape of the conveyance surface, and as a result the toner can be scraped away reliably. Further, the surface area of the contact between the scraping member 24 and the conveyor belt 13 can be modified and adjusted with greater freedom, and therefore the effect of the scraping member 24 on the motion of the conveyor belt 13 (torque loss) can be adjusted. Note that shapes such as those shown in FIGS. 11A and 11B may be applied to a scraping member 24 formed from a non-elastic body.

Note that in the above description, the expression "scrape away" includes actions such as peeling and plucking or any other action for separating and removing toner stuck to the conveyor belt from the conveyor belt. Further, the expression "formed with continuous concavo-convex portions" includes cases in which the concavo-convex portions are formed continuously at an uneven pitch or a partially long pitch, i.e. formed intermittently, and the expression "concave portion" includes a case in which a further concave portion is formed in a single stage or multiple stages from the bottom surface of the concave portion. Also, the expression "the scraping member contacts the conveyor belt" includes a case in which the scraping member contacts the conveyor belt directly or a case in which the scraping member contacts the conveyor belt indirectly via the toner stuck to the conveyor belt.

The present invention described above exhibits the following features and effects.

(1) In a powder conveyance device comprising a powder conveyor belt having a plurality of concavo-convex portions formed continuously on a conveyance surface thereof, and driving means for driving the conveyor belt, a scraping member that contacts the conveyor belt is provided, and at least one of the scraping member and a convex portion of the conveyor belt deforms elastically such that a tip end of the scraping member enters a concave portion and scrapes away a powder stuck to the conveyor belt. When the scraping member contacts the moving conveyor belt, at least one of the scraping member and the convex portion of the conveyor belt deforms elastically and is then elastically restored. At this time, the tip end of the scraping member enters the concave portion, and thus the powder (toner) stuck to the concave and convex portions of the conveyor belt can be scraped away by the scraping member. When the scraping member contacts the convex portion of the conveyor belt, at least one of the scraping member and the convex portion deforms elastically to an extent that allows the conveyor belt to move, and therefore this contact is unlikely to inhibit the movement of the conveyor belt. Further, the subsequent elastic restoring force can be used to scrape away the powder stuck to the conveyor belt efficiently.

(2) A feeding port for leading the powder scraped away by the scraping member to a downstream side is disposed at an identical height to the scraping member or below the scraping member. Hence, the powder scraped away by the scraping member can be conveyed downstream smoothly, and the occurrence of powder jams and the like during conveyance can be suppressed.

(3) The powder stuck to the conveyor belt is scraped toward the feeding port side by the scraping member. Hence, the powder scraped away by the scraping member can be transferred to the feeding port efficiently.

(4) The scraping member contacts the convex portion of the conveyor belt but does not contact a bottom surface of the concave portion. Hence, the scraping member can scrape away the powder stuck to the conveyor belt reliably by contacting the convex portion. Meanwhile, by avoiding contact between the scraping member and the bottom portion of the concave portion, torque loss generated in the driving means of the conveyor belt can be suppressed, and the scraping member is unlikely to inhibit the movement of the conveyor belt.

(5) The convex portion of the conveyor belt is formed from a non-elastic body and the scraping member is formed from an elastic body. By forming the convex portion of the conveyor belt from a non-elastic body, the powder can be accommodated between convex portions and conveyed with stability. By forming the scraping member from an elastic body, the scraping member deforms elastically upon contact with the convex portion to an extent that allows the conveyor belt to move. Therefore, this contact is unlikely to inhibit the movement of the conveyor belt, and the (lumps of) powder stuck to the conveyor belt can be broken down and scraped away when the scraping member is elastically restored thereafter.

(6) The scraping member is formed from polyethylene terephthalate (PET). Hence, the scraping member has excellent durability and can be manufactured using a reasonably priced material.

(7) The modulus of elasticity of the scraping member is set at a lower limit of 1 GPa and an upper limit of 10 GPa. By setting the modulus of elasticity within this range, the scraping member can elastically deform to an extent that allows the conveyor belt to move smoothly when the scraping member contacts the convex portion, and moreover, the restoring force that is exhibited following elastic deformation can be used to scrape away the toner stuck to the conveyor belt.

(8) The scraping member contacts the conveyor belt in a plurality of width direction locations. Hence, the scraping member can be caused to contact the convex portion in accordance with the shape of the conveyor belt and the manner in which the powder is stuck thereto, and the shape of the scraping member can be modified easily to improve the scraping ability thereof.

(9) A collection unit for collecting the powder conveyed by the conveyor belt from the feeding port is provided, and at least a part of the collection unit is capable of deformation. Hence, the powder can be accommodated in the collection unit efficiently, and a reduction in the size of the collection unit can be realized while achieving an increase in the essential storage capacity thereof.

(10) A belt advancement direction-side angle formed by a movement path reference line of the conveyor belt and an extension line of the scraping member in contact therewith is set at an acute angle. Hence, the scraping member formed from an elastic body is capable of large elastic deformation upon contact with the convex portion of the conveyor belt. As a result, the (lumps of) powder stuck to the conveyor belt can be broken down and scraped away efficiently using the large elastic restoring force of the scraping member.

(11) The scraping member contacts the conveyor belt in a location of the conveyance surface that faces downward as the conveyor belt moves diagonally upward. By providing the scraping member in this position, a receiving member for receiving the powder that has been scraped away by the scraping member, a discharge port, and so on can be disposed easily beneath the tip end of the scraping member. Further, the convex portion of the conveyor belt contacts the scraping member from below, and therefore the powder can be scraped away by the lower surface side of the scraping member such that when the tip end of the scraping member swings downward due to elastic restoration thereof, the powder that has been scraped away by the lower surface side can be scraped downward quickly.

(12) The tip end of the scraping member enters the concave portion of the conveyor belt at a turning portion where the conveyor belt turns. At the turning portion, adjacent convex portions of the conveyor belt bend, thereby separating from each other such that the concave portion widens. As a result of this bending deformation and the consequent enlargement of the concave portion space, the powder in the concave portion is loosened and the tip end of the scraping member enters the concave portion more easily, and therefore the powder stuck to the conveyor belt can be scraped away reliably.

(13) When a powder conveyance device comprising the scraping member described above is used as a toner conveyance device, the scraping member scrapes away and removes toner stuck to the conveyor belt. As a result, a situation in which the toner deteriorates and becomes stuck to the conveyor belt, leading to a reduction in the toner conveyance ability, can be prevented.

(14) By providing a process cartridge that has a cleaning device for removing residual toner from an image carrier and can be attached to and detached from an image forming apparatus main body with a toner conveyance device for conveying the residual toner removed by the cleaning device, a situation in which the toner deteriorates and becomes stuck to the conveyor belt, leading to a reduction in the toner conveyance ability, can be prevented.

(15) By providing an image forming apparatus having a cleaning device for removing residual toner from an image carrier with a toner conveyance device for conveying the residual toner removed by the cleaning device, a situation in which the toner deteriorates and becomes stuck to the conveyor belt, leading to a reduction in the toner conveyance ability, can be prevented.

According to the powder conveyance device of the present invention, which was described in detail above, at least one of a scraping member and a convex portion of a conveyor belt deforms elastically such that even when the conveyor belt has a complicated conveyance surface constituted by a plurality of concavo-convex portions, the tip end of the scraping member is capable of entering the concave portion and scraping away powder stuck to the conveyor belt reliably, whereby the powder is separated and removed. As a result, a reduction in conveyance ability caused by powder stuck to the concave portions of the conveyor belt and so on can be prevented, and maintenance operations on the conveyance device can be reduced. Further, the toner conveyance device of the present invention and the process cartridge and image forming apparatus comprising the toner conveyance apparatus are capable of exhibiting similar effects to the powder conveyance device.

Various modifications will become possible for those skilled in the art after receiving the teachings of the present disclosure without departing from the scope thereof. For example, the angle of incline of the conveyor belt 13 relative to the horizontal plane is set at approximately 65°, but the conveyor belt 13 may be inclined at another angle, or may convey the powder in a horizontal direction or a vertical direction. Further, the powder conveyance device of the present invention may be provided in an apparatus other than an image forming apparatus, and may be used to convey a powder other than toner.

What is claimed is:

1. A powder conveyance device comprising:

a powder conveyor belt having a plurality of concavo-convex portions formed continuously on a conveyance surface thereof;

driving means for driving said conveyor belt; and a scraping member that contacts said conveyor belt, and a modulus of elasticity of said scraping member is set at a lower limit of 1 GPa and an upper limit of 10 GPa, wherein at least one of said scraping member and a convex portion of said conveyor belt deforms elastically such that a tip end of said scraping member enters a concave portion and scrapes away a powder stuck to said conveyor belt, and wherein said scraping member contacts said convex portion of said conveyor belt but does not contact a bottom surface of said concave portion.

2. The powder conveyance device as claimed in claim 1, wherein a feeding port for leading said powder scraped away by said scraping member to a downstream side is disposed at an identical height to said scraping member or below said scraping member.

3. The powder conveyance device as claimed in claim 2, wherein said powder stuck to said conveyor belt is scraped toward said feeding port side by said scraping member.

4. The powder conveyance device as claimed in claim 2, further comprising a collection unit for collecting said powder conveyed by said conveyor belt from said feeding port, at least a part of said collection unit being capable of deformation.

5. The powder conveyance device as claimed in claim 1, wherein said convex portion of said conveyor belt is formed from a non-elastic body and said scraping member is formed from an elastic body.

6. The powder conveyance device as claimed in claim 5, wherein a belt advancement direction-side angle formed by a movement path reference line of said conveyor belt and an extension line of said scraping member in contact therewith is set at an acute angle.

7. The powder conveyance device as claimed in claim 1, wherein said scraping member is formed from polyethylene terephthalate (PET).

8. The powder conveyance device as claimed in claim 1, wherein said scraping member contacts said conveyor belt in a plurality of width direction locations.

9. The powder conveyance device as claimed in claim 1, wherein said scraping member contacts said conveyor belt in a location of said conveyance surface that faces downward as said conveyor belt moves diagonally upward.

10. The powder conveyance device as claimed in claim 1, wherein said tip end of said scraping member enters said concave portion of said conveyor belt at a turning portion where said conveyor belt turns.

11. A toner conveyance device for conveying toner using a powder conveyance device, said powder conveyance device comprising:

a powder conveyor belt having a plurality of concavo-convex portions formed continuously on a conveyance surface thereof;

driving means for driving said conveyor belt; and a scraping member that contacts said conveyor belt, and a modulus of elasticity of said scraping member is set at a lower limit of 1 GPa and an upper limit of 10 GPa, wherein at least one of said scraping member and a convex portion of said conveyor belt deforms elastically such that a tip end of said scraping member enters a concave portion and scrapes away a powder stuck to said conveyor belt, and wherein said scraping member contacts said convex portion of said conveyor belt but does not contact a bottom surface of said concave portion.

12. A process cartridge that can be attached to and detached from an image forming apparatus main body, having a cleaning device for removing residual toner from an image carrier and a toner conveyance device for conveying said residual toner removed by said cleaning device, in which said toner conveyance device conveys said toner using a powder conveyance device, and said powder conveyance device comprises:

a powder conveyor belt having a plurality of concavo-convex portions formed continuously on a conveyance surface thereof;

driving means for driving said conveyor belt; and a scraping member that contacts said conveyor belt, and a modulus of elasticity of said scraping member is set at a lower limit of 1 GPa and an upper limit of 10 GPa, wherein at least one of said scraping member and a convex portion of said conveyor belt deforms elastically such that a tip end of said scraping member enters a concave portion and scrapes away a powder stuck to said conveyor belt, and wherein said scraping member contacts said convex portion of said conveyor belt but does not contact a bottom surface of said concave portion.

13. An image forming apparatus having a cleaning device for removing residual toner from an image carrier and a toner conveyance device for conveying said residual toner removed by said cleaning device, in which said toner conveyance device conveys said toner using a powder conveyance device, and said powder conveyance device comprises:

a powder conveyor belt having a plurality of concavo-convex portions formed continuously on a conveyance surface thereof;

driving means for driving said conveyor belt; and a scraping member that contacts said conveyor belt, and a modulus of elasticity of said scraping member is set at a lower limit of 1 GPa and an upper limit of 10 GPa, wherein at least one of said scraping member and a convex portion of said conveyor belt deforms elastically such that a tip end of said scraping member enters a concave portion and scrapes away a powder stuck to said conveyor belt, and wherein said scraping member contacts said convex portion of said conveyor belt but does not contact a bottom surface of said concave portion.

* * * * *